US011149523B2

(12) United States Patent
Saraya et al.

(10) Patent No.: US 11,149,523 B2
(45) Date of Patent: Oct. 19, 2021

(54) METHODS AND SYSTEMS FOR CREATING AN INTERVENTIONLESS CONDUIT TO FORMATION IN WELLS WITH CASED HOLE

(71) Applicant: Vertice Oil Tools, Missouri City, TX (US)

(72) Inventors: Mohamed Ibrahim Saraya, Sugar Land, TX (US); Stephen Parks, Houston, TX (US); Michael Lo, Missouri City, TX (US)

(73) Assignee: Vertice Oil Tools, Missouri City, TX (US)

( * ) Notice: Subject to any disclaimer, the term of this patent is extended or adjusted under 35 U.S.C. 154(b) by 27 days.

(21) Appl. No.: 16/797,489

(22) Filed: Feb. 21, 2020

(65) Prior Publication Data

US 2021/0032958 A1 Feb. 4, 2021

Related U.S. Application Data

(63) Continuation-in-part of application No. 16/527,714, filed on Jul. 31, 2019, now Pat. No. 10,619,452.

(51) Int. Cl.

| | |
|---|---|
| ***E21B 34/14*** | (2006.01) |
| ***E21B 23/00*** | (2006.01) |
| ***E21B 34/06*** | (2006.01) |
| ***E21B 33/14*** | (2006.01) |

(52) U.S. Cl.
CPC ..... *E21B 34/063* (2013.01); *E21B 33/14* (2013.01); *E21B 2200/06* (2020.05)

(58) Field of Classification Search
CPC ..... E21B 33/13; E21B 34/12; E21B 34/14; E21B 34/125; E21B 34/16; E21B 41/0078; E21B 37/00; E21B 23/00
See application file for complete search history.

(56) References Cited

U.S. PATENT DOCUMENTS

| | | | | |
|---|---|---|---|---|
| 6,003,607 | A * | 12/1999 | Hagen | E21B 17/07 166/120 |
| 6,079,496 | A * | 6/2000 | Hirth | E21B 34/14 166/321 |
| 9,016,388 | B2 * | 4/2015 | Kellner | E21B 34/063 166/386 |
| 9,353,599 | B2 * | 5/2016 | Watson | E21B 43/26 |
| 10,352,119 | B2 * | 7/2019 | Doane | E21B 23/065 |
| 10,619,452 | B1 * | 4/2020 | Saraya | E21B 34/14 |
| 2012/0261131 | A1 * | 10/2012 | Hofman | E21B 34/14 166/316 |

* cited by examiner

*Primary Examiner* — Kenneth L Thompson
(74) *Attorney, Agent, or Firm* — Pierson, IP PLLC

(57) ABSTRACT

A toe sleeve that is configured to disconnect from casing. More specifically, a toe sleeve that is configured to shear from casing creating a dynamic opening that does not get plugged.

16 Claims, 17 Drawing Sheets

METHODS AND SYSTEMS FOR CREATING AN INTERVENTIONLESS CONDUIT TO FORMATION IN WELLS WITH CASED HOLE

BACKGROUND INFORMATION

Field of the Disclosure

Examples of the present disclosure relate to a toe sleeve that is configured to disconnect from casing. More specifically, embodiments include a toe sleeve that is configured to shear from casing, providing a conduit to the formation, while creating a dynamic opening that does not get plugged.

Background

Directional drilling is the practice of drilling non-vertical wells. Horizontal wells tend to be more productive than vertical wells because they allow a single well to reach multiple points of the producing formation across a horizontal axis without the need for additional vertical wells. This makes each individual well more productive by being able to reach reservoirs across the horizontal axis. While horizontal wells are more productive than conventional wells, horizontal wells are costlier.

Conventionally, casing is run in hole, and cement is pumped through the inner diameter of the casing. Subsequently, the cement is cleaned through the inner diameter of the tool via wipers and other systems. Toe sleeves are conventionally run in at the toe of a horizontal section of a well to establish circulation. Conventional toe sleeves include an internal sleeve that is shear pined in place, and designed to shear. This allows the internal sleeve to slide downward which establishes the required communication with the formation to proceed with the frac operation. If a conventional toe sleeve is not run, then it is required from the operator to utilize perforating guns mounted on stick pipes or coiled tubing to establish this communication.

However, due to geometric properties of the wipers and the casing, the wipers are not entirely effective while being able to pass through the casing and toe sleeve. This can lead to the cementing of the toe sleeves, where the toe sleeves are not able to move and open, or ports within the toe sleeve being sealed and the plugging of the toe sleeve. In other occasions, even if the toe sleeves are not cemented, the limited area of openings may get plugged due to the cement sheath breaking up from casing internal diameter during pressure up. This cement sheath may cause the ports to get plugged. This same problem applies when utilizing a perforating gun due the limited entry holes. As such, conventional methods are hampered with plugging issues.

Accordingly, needs exist for systems and methods for a toe sleeve configured to be disconnected from a casing, wherein fluid is pumped into a casing after the cement is pumped downhole allowing the toe sleeve to disconnect from the casing creating a dynamic opening that does not get plugged.

SUMMARY

Embodiments disclosed herein describe systems and methods a toe sleeve is configured to be disconnected from a casing, wherein fluid is pumped into a casing after the cement is pumped downhole and before launching the tail wiper plug. This permits the fluid to create a wet chamber toward the toe of the well. Therefore, the toe sleeve may not be cemented in place, allowing the toe sleeve to disconnect from the casing creating a dynamic opening that does not get plugged.

Embodiments may include casing and a toe sleeve.

The casing may be configured to be installed into a well before other tools or equipment is run into the well. The casing may include a hollow channel, passageway, conduit, etc. extending from a proximal end of the casing to a distal end of the casing. The casing may be a hollow diameter pipe that is assembled and inserted into a recently drilled section of a borehole.

The toe sleeve may be configured to be positioned on a distal end of the casing. The toe sleeve may include and upper body and a lower body. The lower body may be configured to be sheared/disconnect from a distal end of the upper body to create a dynamic opening that does not get plugged. This may allow communication directly out of the distal end of the lower body.

In embodiments, cement may be pumped through the casing, and recirculate into an annulus positioned between an outer diameter of the casing and a formation or parent casing. After casing is pumped downhole, fluid, such as brine may be pumped in pre-calculated quantity downhole and prior to launching the wiper plug. The fluid may displace the cement surrounding the outer diameter of the toe sleeve, which may allow the toe sleeve to not be cemented, creating a wet chamber. Subsequently, fluid may be pumped through the casing, which may allow a lower body of the toe sleeve to move towards the distal end of the tool. This may expose ports associated with the casing, and/or allow the lower body of the toe sleeve to be disconnected from the upper body of the toe sleeve and travel downhole.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
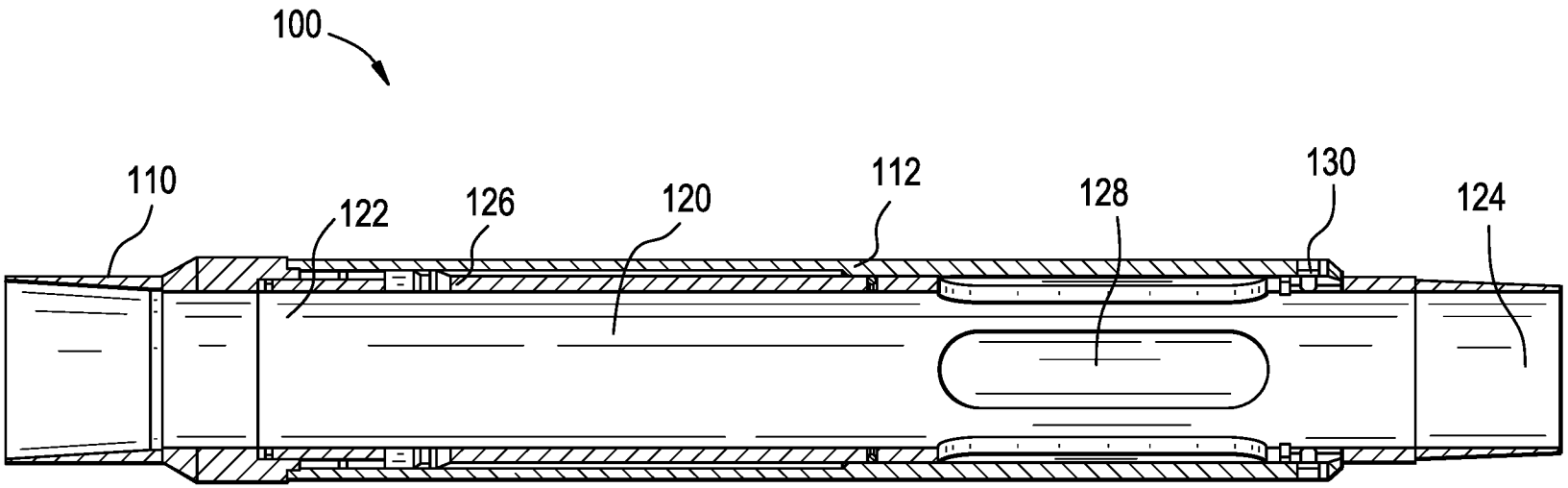
FIGS. 1 and 2 depict a toe sleeve for use within a wellbore, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

FIG. 1 depicts a toe sleeve 100 for use within a wellbore, according to an embodiment. Toe sleeve 100 may include upper body 110 and lower body 120. In embodiments, toe sleeve 100 may be positioned within a wellbore, and cement may be run through the inner diameter of toe sleeve 100, and through distal end 124 of lower body 120. Subsequently, fluid, such as brine, may flow through toe sleeve 100, and encompass the outer circumference of toe sleeve 100. This may enable the creation of a wet chamber where the disconnect of lower body 120 from upper body 110 is possible due to toe sleeve 100 not being cemented downhole and by applying pressure against the plugged toe sleeve 100 and/or wiper plug which landed in landing collar below.

upper body 110 may be a large diameter pipe that is lowered into an open wellbore. upper body 110 may be configured to withstand a variety of physical forces and chemical impacts. upper body 110 may be configured to provide structural support for the wellbore, isolating formations, and provide a means of controlling the flow of fluid through the wellbore. Upper body 110 may include an indention 112 that is configured to decrease the inner diameter across Upper body 110. This may enable indention 122 to act as a no-go, stop, etc. to limit the movement of lower body 120, Upper body 110 may also include two internal diameters. The larger inner diameter of upper body 110 may be positioned, trapped, etc. between seals, creating an atmospheric chamber. The atmospheric chamber may be configured to aid in the activation and movement of the toe sleeve by amplifying the force against lower body 120.

Lower body 120 may be a sleeve that is configured to move to allow communication between an inner diameter of the tool, annulus, and formation. Lower body 120 may be positioned at the bottom or toe of an upper body 110. Lower body 120 may have a smaller inner diameter than that of upper body 110. Fluid may be configured to flow through lower body 120 to allow cement, fluid, etc. to circulate from an area within toe sleeve 100 to encompass or be positioned around an outer circumference of lower body 120. Lower body 120 may include a proximal end 122, distal end 124, projection 126, and ports 128.

Lower body 120 may be configured to be coupled to upper body 110 via temporary coupling mechanisms 130, such as shear screws, shear ring, dissolvable ring, etc. In embodiments, the temporary coupling mechanisms 130 may be configured to shear responsive to a pressure within the inner diameter of toe sleeve 100 increasing past a threshold. When the temporary coupling mechanisms 130 shear, lower body 120 may be able to move along a linear axis within upper body 110.

Projection 126 may be positioned on the outer diameter of lower body 120, and may be configured to increase the outer diameter of lower body 120. Responsive to the temporary coupling mechanisms 130 shearing, lower body 120 may slide within upper body 110 until projection 126 is positioned adjacent to indentation 112, which may restrict the movement of toe sleeve towards a distal end of upper body 110.

Ports 128 may be large openings, passageways, etc. extending through sidewalls of lower body 120. Ports 128 may be configured to allow communication from an area within toe sleeve 100 to an area outside of toe sleeve 100. This may allow the formation to be fractured through the ports 128, and/or allow frac plugs to be pumped downhole.

In an initial mode, run in hole, a body of lower body 120 including proximal end 122 and ports 128 may be encompassed by upper body 110.

Figure 2:
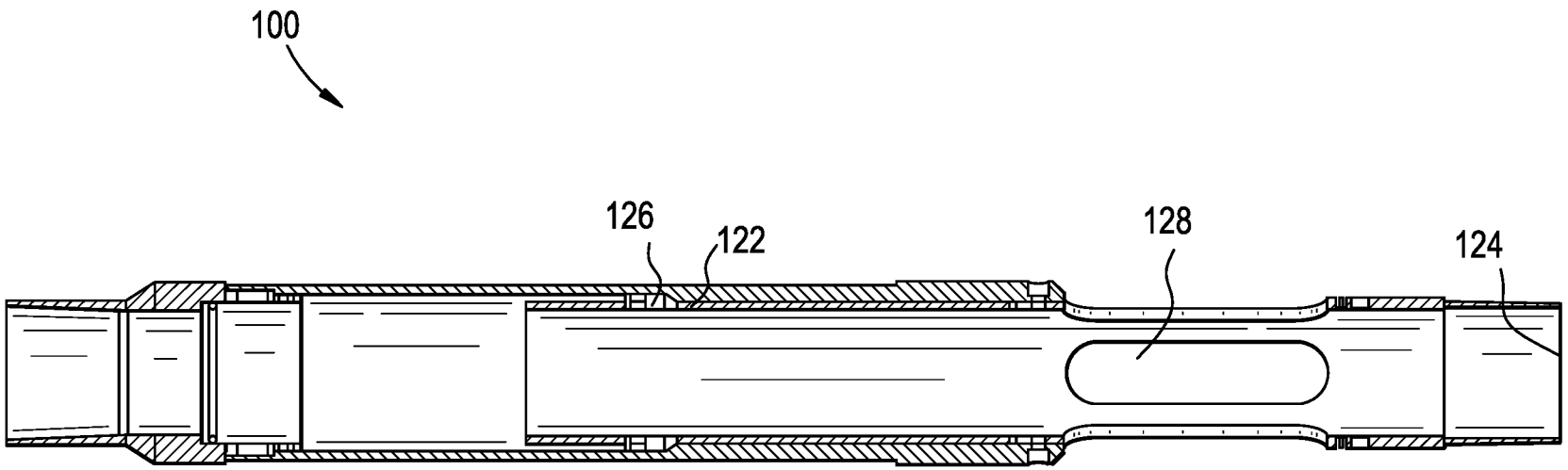

As depicted in FIG. 2, responsive to flowing fluid within the inner diameter of toe sleeve 100, the pressure within toe sleeve 100 may increase past a threshold, which may shear the temporary coupling mechanisms. This may enable lower body 120 to move down hole until projection 126 interfaces with indentation 112, which may restrict the movement of lower body 120 towards the distal end of toe sleeve 100. When moving lower body 120, ports 128 may become directly exposed and no longer be encompassed by upper body 110. This may enable direct communication between an area within toe sleeve 100 and outside of toe sleeve 100. Further, the movement of the distal end 124 of lower body 120 may be made possible due to fluid, and not cement, encompassing an area outside of toe sleeve 100. This is contrary to conventional designs where the movement of the inner sleeve doesn't cause moving the lower body 120 or the lower connected tools below it. This may enable the movement of a bottom sub, casing, tools, etc. positioned below lower body 120.

Furthermore, by positioning ports 128 within lower body 120, and allowing access to the formation through ports 128, weak points associated with ports within upper body 110 may be removed.

Figure 3:
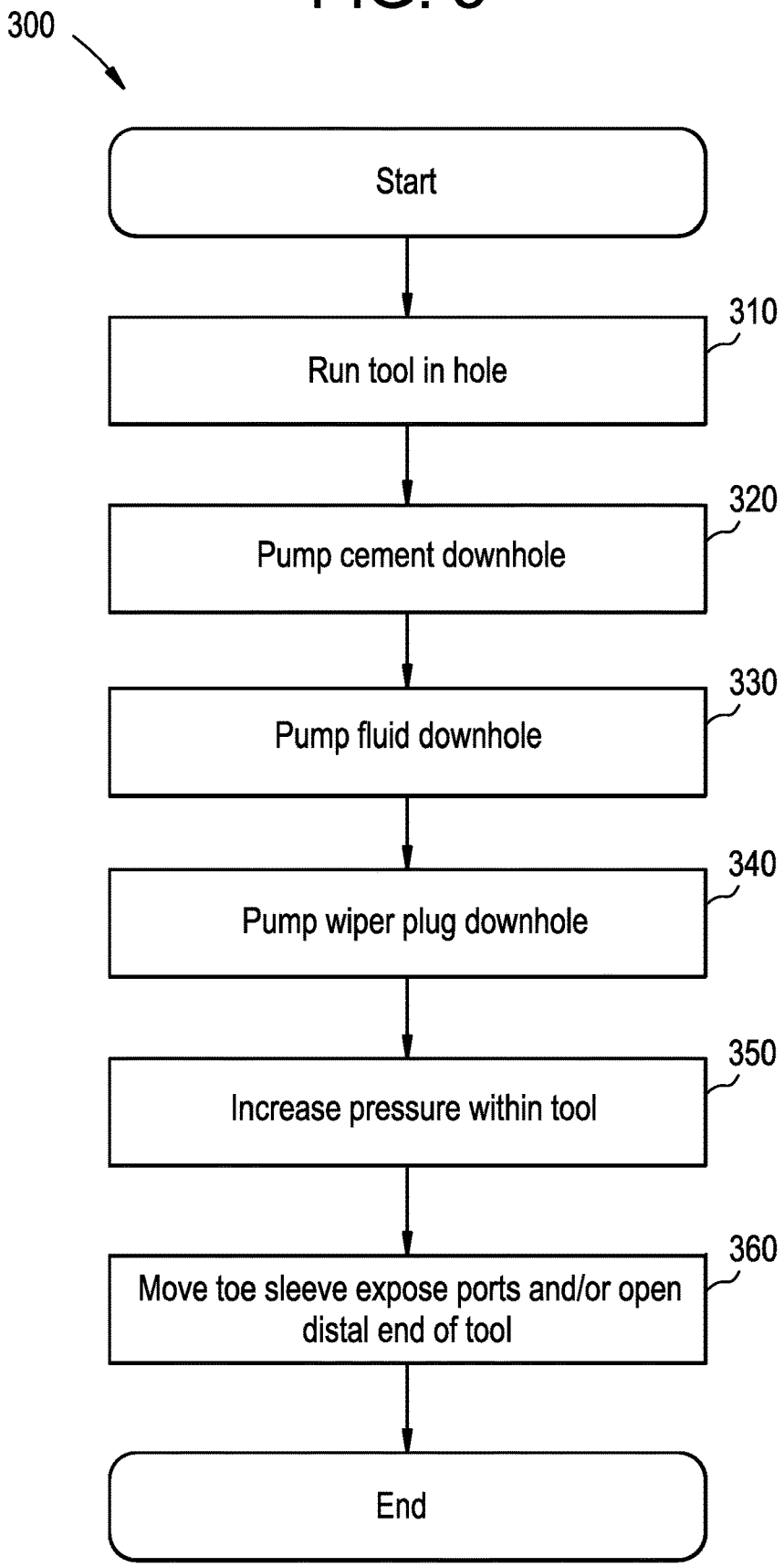
FIG. 3 depicts a method for disconnecting an upper and lower body of a toe sleeve, according to an embodiment.

FIG. 3 depicts a method 300 for disconnecting an upper and lower body of a toe sleeve, according to an embodiment. The operations of operational sequence presented below are intended to be illustrative. In some embodiments, operational sequence may be accomplished with one or more additional operations not described, and/or without one or more of the operations discussed. Additionally, the order in which the operations of operational sequence are illustrated in FIG. 3 and described below is not intended to be limiting. Furthermore, the operations of operational sequence may be repeated for subsequent valves or zones in a well.

At operation 310, a tool may be run in hole.

At operation 320, cement may be pumped downhole through the inner diameter of casing, and into an annulus from the distal end of the tool. The cement that flows into the annulus may be configured to flow uphole to cement portions of the outer circumference of the casing to a wellbore wall.

At operation 330, fluid, such as freshwater, brine, etc., may be pumped downhole. The pumped fluid may be configured to displace the cement encompassing the outer circumference of the distal end of the tool. This may create a wet shoe, wet compartment, and allow movement of components positioned at the distal end of the tool, such as allowing the toe sleeve to not be cemented to the wellbore wall. In embodiments, portions of an annulus positioned around an outer diameter of the casing may be cemented in place, while portions of the annulus aligned with the toe sleeve may be encompassed by fluid and not cemented in place.

At operation 340, a wiper plug may be pumped downhole through the inner diameter of the tool, and the wiper plug may pass through the toe sleeve.

At operation 350, fracturing fluid may be pumped downhole through the inner diameter of the casing and toe sleeve, this may cause the pressure within the casing and toe sleeve to increase past a first threshold. In certain embodiments this may cause a weak point, rupture disc, etc. within the lower body to be removed, flooding an atmospheric chamber, and increasing a piston area associated with the lower body.

At operation 360, responsive to increasing the pressure within the tool past the first threshold, a lower body of a toe sleeve may become decoupled from the upper body of the toe sleeve and travel downhole. The lower body of toe sleeve may travel downhole to expose ports to an annulus positioned between the toe sleeve and the casing, and/or the toe sleeve may travel downhole and become completely separate from the casing above. In further embodiments, the lower body of the toe sleeve may continue to travel downhole, such that no portion of the lower body is encompassed by the upper body of the toe sleeve.

Figure 4:
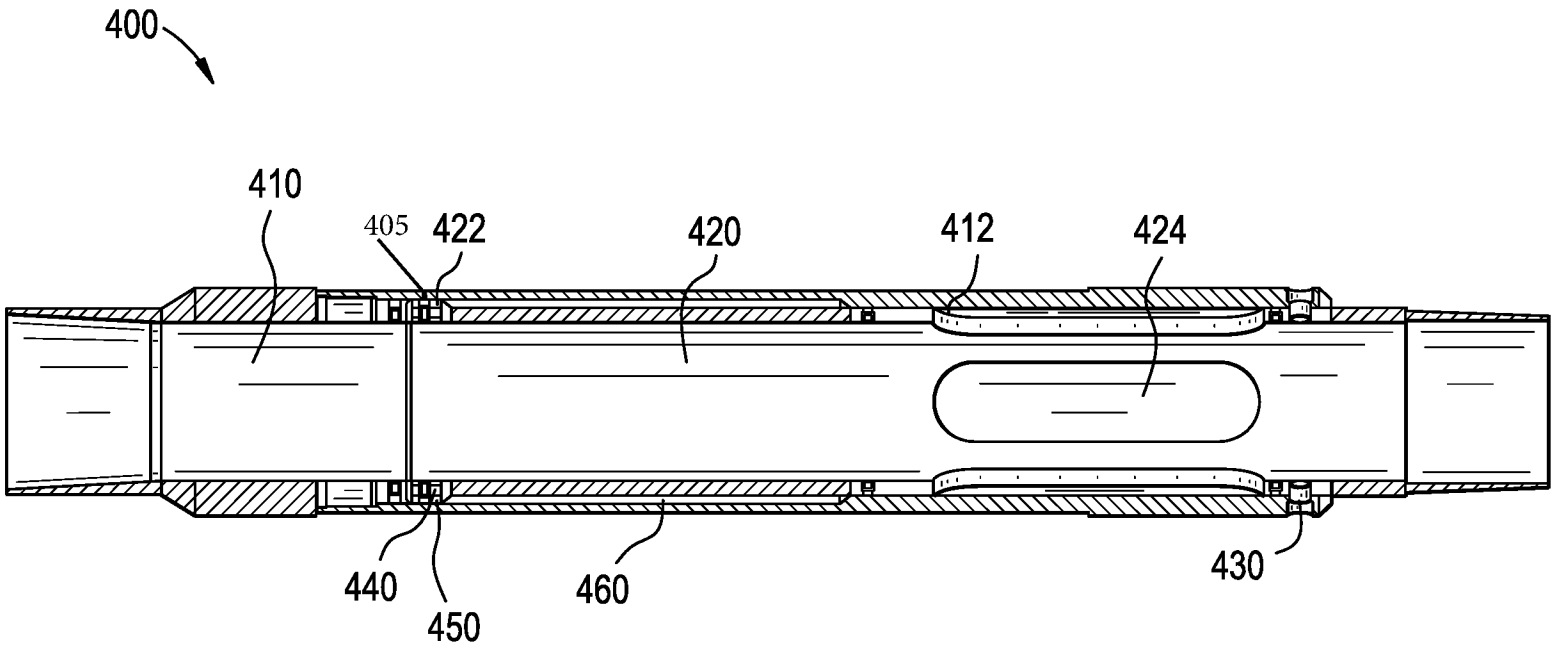
FIGS. 4 and 5 depict a lower body that is configured to be decoupled to an upper body, according to an embodiment.
Figure 5:
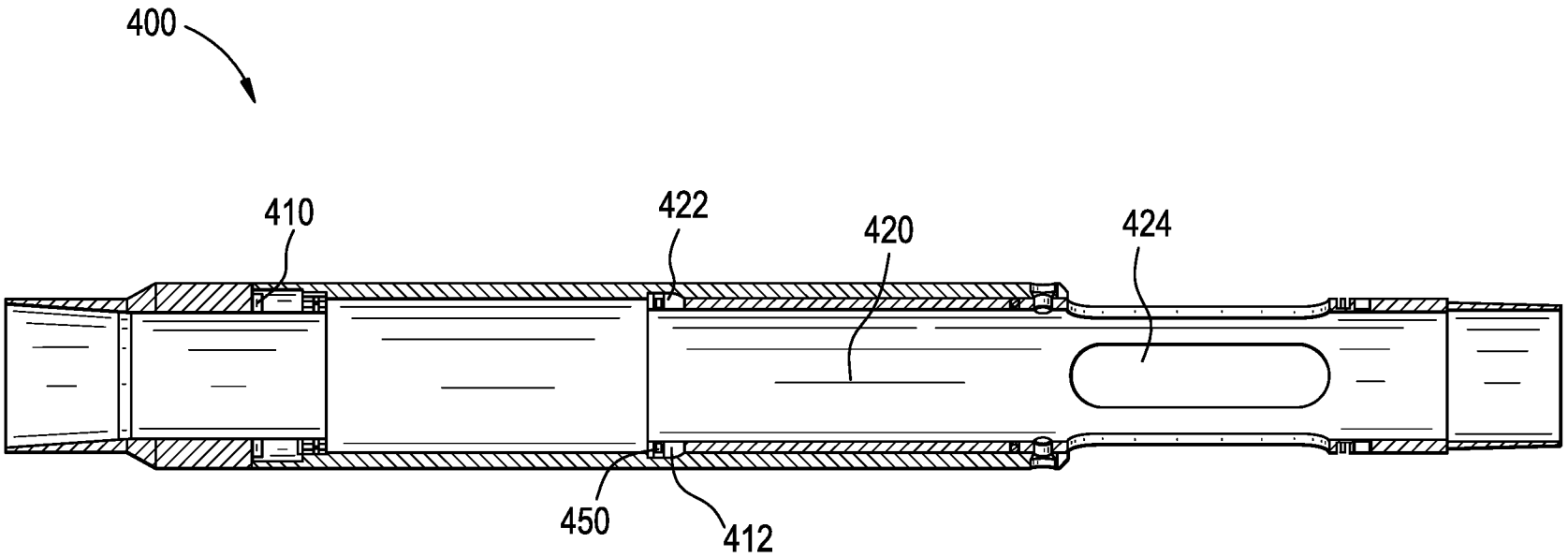

FIGS. 4 and 5 depict a lower body 420 that is configured to be decoupled to upper body 410, according to an embodiment.

In embodiments, lower body 420 may be encompassed by brine, and not cement. This may allow for the movement of lower body 420 downhole. Upper body 420 may be temporarily coupled to upper body 410 via temporary coupling mechanisms 430. The lower body 420 may be equipped with rupture disc 440 that creates a first atmospheric chamber 450 between the external diameter of lower body 420 and the inner diameter of upper body 410, wherein first atmospheric chamber 450 may initially have a static pressure. Further, there may be second atmospheric chamber 460 that also has an initial static pressure, wherein the second atmospheric chamber is positioned between the external diameter of lower body 420 and the inner diameter of upper body 410. Responsive to flowing fluid through the inner diameter of the tool, the pressure within the inner diameter may increase past a threshold, rupturing the rupture disc 440, flooding first atmospheric chamber 450 and increasing the piston area of the pressure trying to sever/shear lower body 420 from upper body 410. More specifically, initially a proximal end of lower body 420 may be positioned adjacent to a shoulder of upper body 410, wherein the proximal end of lower body has a larger outer diameter than other portions of lower body. When rupture disc 440 is removed, a larger piston area may be formed by exposing the proximal end of lower body 420, which may amplify the forces applied to coupling mechanisms 430. This amplified force may be applied to temporary coupling mechanisms 430 to shear, sever, etc. and decouple lower body 420 from upper body 410.

Furthermore, embodiments may include a weep hole 405 that extends through a diameter of upper body 410. Weep hole 405 may be configured to communicate with an outer diameter of rupture disc 440 when temporary coupling mechanisms 430 are coupling lower body 420 and upper body 410. Weep hole 405 may be configured to allow communication between exterior of the upper body 410 and the outer diameter of the rupture disc 440, preventing the creation of an atmospheric chamber against the outer diameter of the rupture disc 440

As depicted in FIG. 5, because a distal end of lower body 420 is not cemented in place, the distal end of lower body 420 may slide downhole and expose ports 424 to the formation. lower body 420 may be restricted from moving downhole responsive to projection 420 interfacing with indentation 422.

Figure 6:
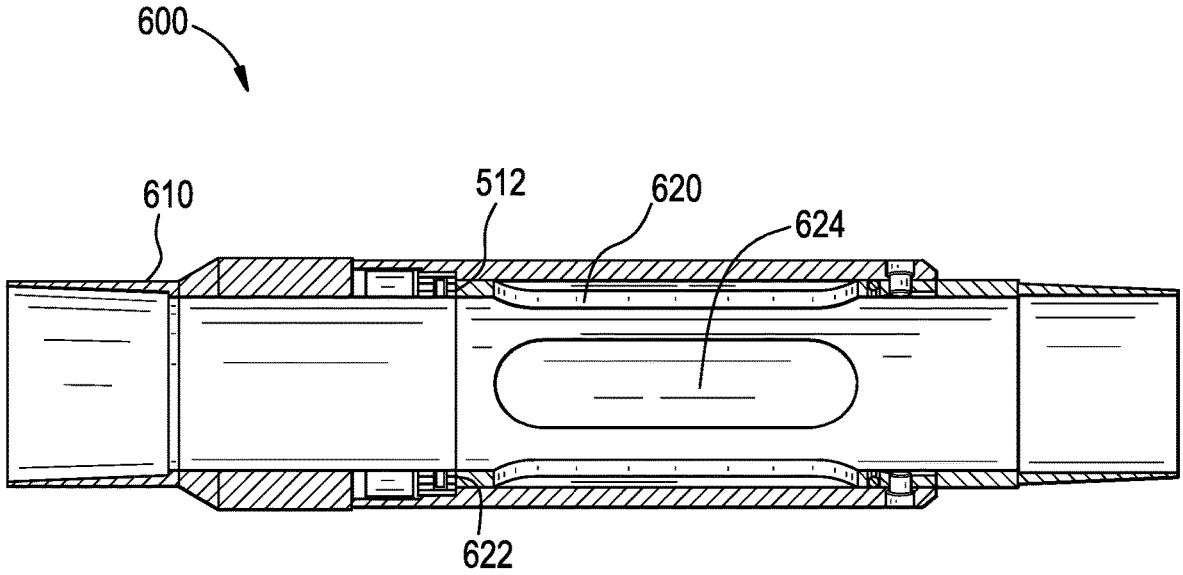
FIGS. 6-8 depict a lower body of a toe sleeve that is configured to be completely detached from an upper body, according to an embodiment.
Figure 7:
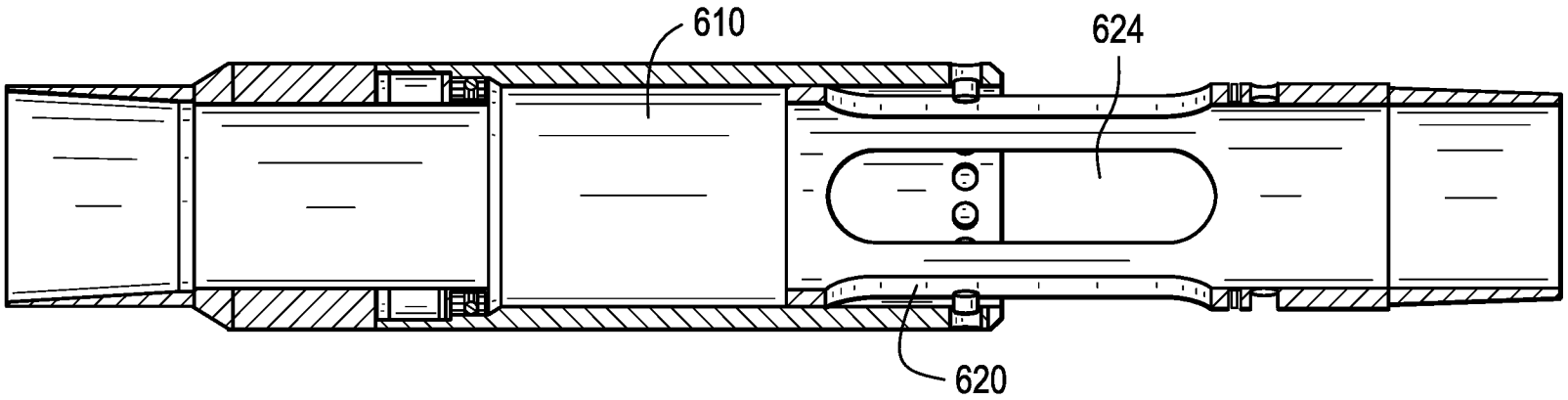
Figure 8:
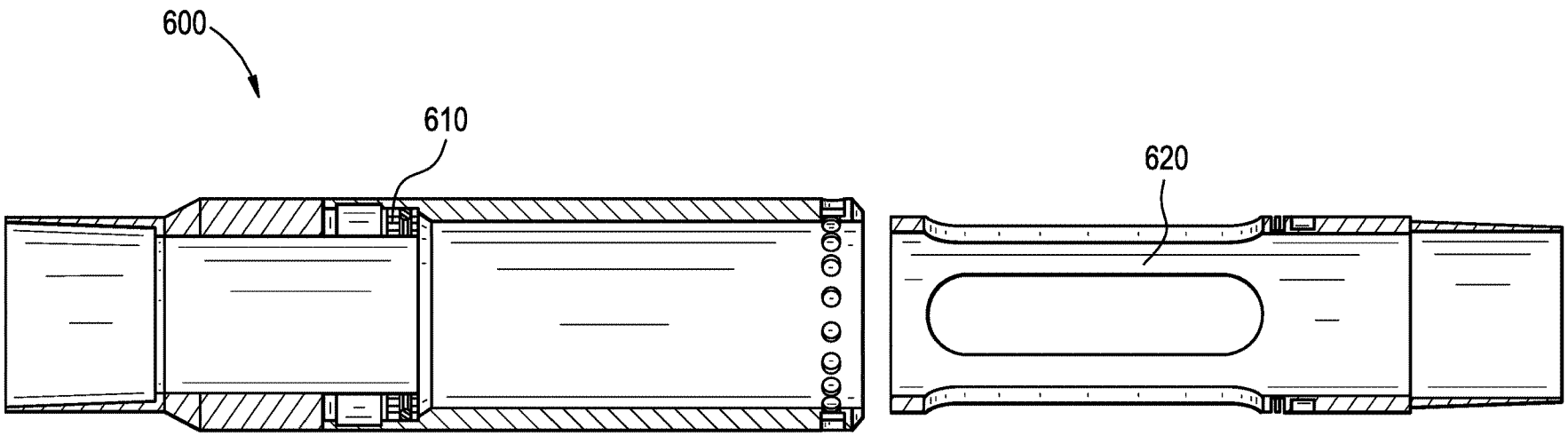

FIGS. 6-8 depict a lower body 620 of a toe sleeve 600 that is configured to be completely detached from upper body 610, according to an embodiment.

As depicted in FIG. 6, a proximal end 622 of lower body 620 may be configured to be positioned adjacent to an indentation 512 on upper body. This may limit the movement of lower body 620 towards a first end of upper body.

As shown in FIG. 7, responsive to flowing fluid through the inner diameter of upper body, lower body 620 may move in a second direction towards a distal end of the upper body. This may slide lower body 620 to expose ports 624 to an annulus and/or formation.

As depicted in FIG. 8, as fluid flows through the inner diameter of the tool, the pressure/force of the fluid may cause a proximal end of lower body 620 to be positioned remote from the distal end of upper body 610. As such, the lower body 620 may travel downhole, leaving the distal end of upper body 610 unobstructed. The distance between upper body 610 and lower body 620 may continue to increase due to pressure increase as more debris starts accumulating and chocking, making the tool a fully dynamic tool, wherein a distal end of upper body 610 is fully open.

Figure 9:
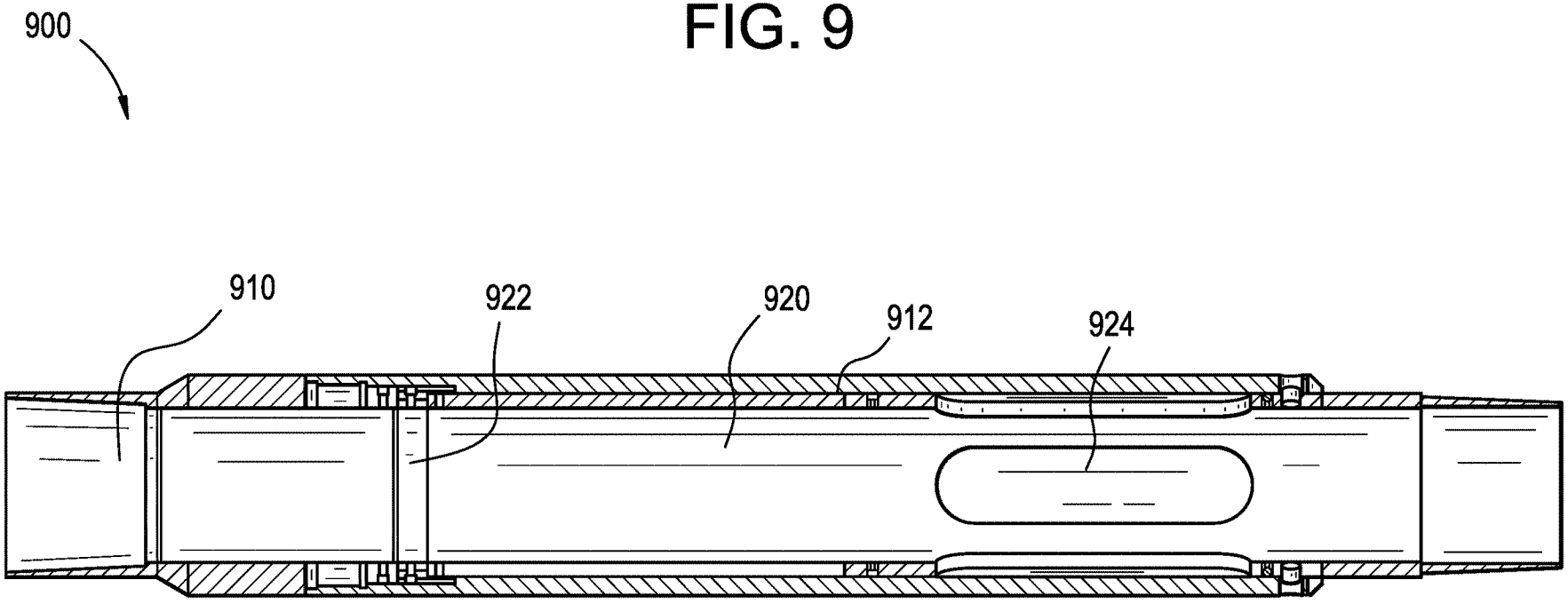
FIGS. 9-11 depict a toe sleeve with a lower body that is configured to be completely detached from an upper body, according to an embodiment.
Figure 10:
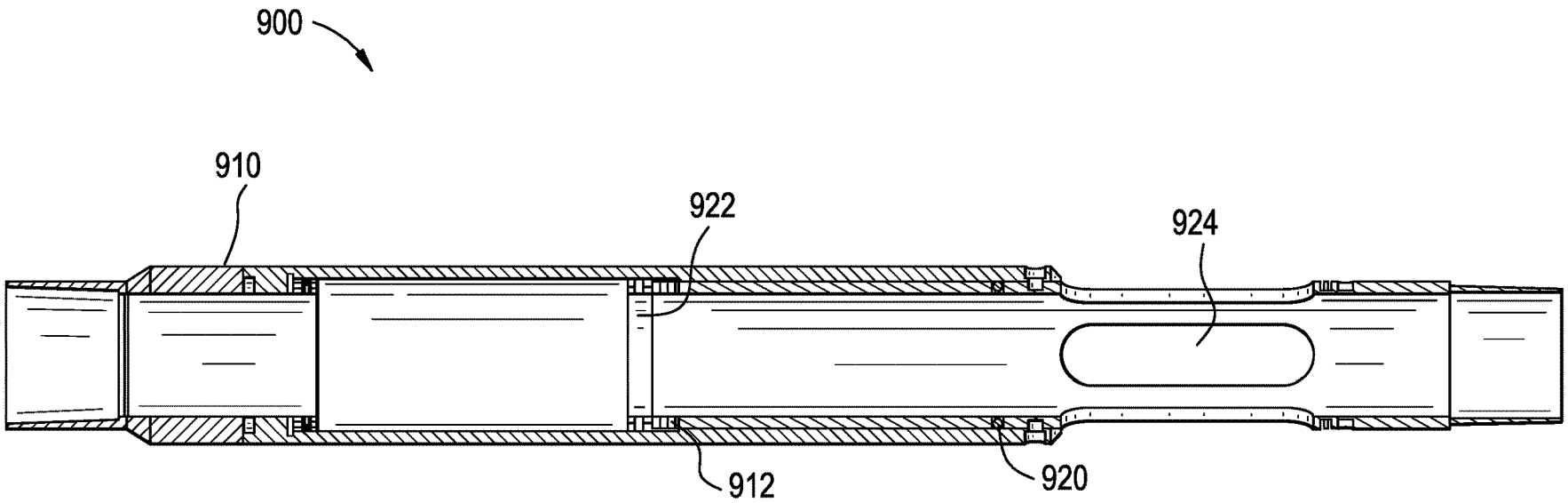
Figure 11:
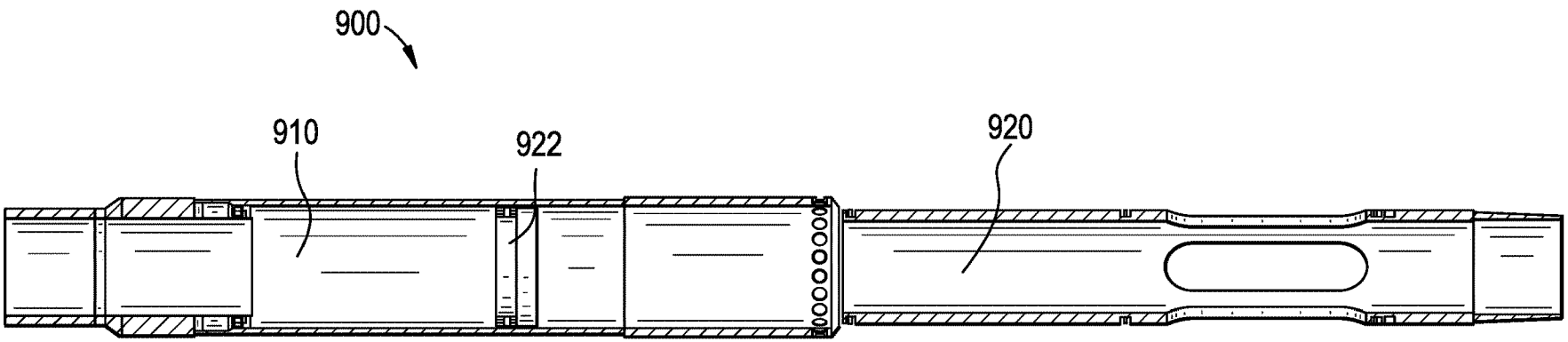

FIGS. 9-11 depict a toe sleeve 900 with a lower body 920 that is configured to be completely detached from upper body 910, according to an embodiment.

As depicted in FIG. 9-11, responsive to fluid flowing through an inner diameter of toe sleeve 900, a proximal end 922 of lower body 920 may be positioned adjacent to indentation 912.

Responsive to increasing the pressure within toe sleeve 900, proximal end 922 of lower body 920 may positioned adjacent to indentation 912 on upper body 910. When the pressure within toe sleeve 900 increases past a threshold, proximal end 922 of lower body 920 may shear/disengage from a body of toe sleeve 920. This may enable lower body 920 to be removed from the inner diameter of upper body 910 and travel downhole.

Figure 12:
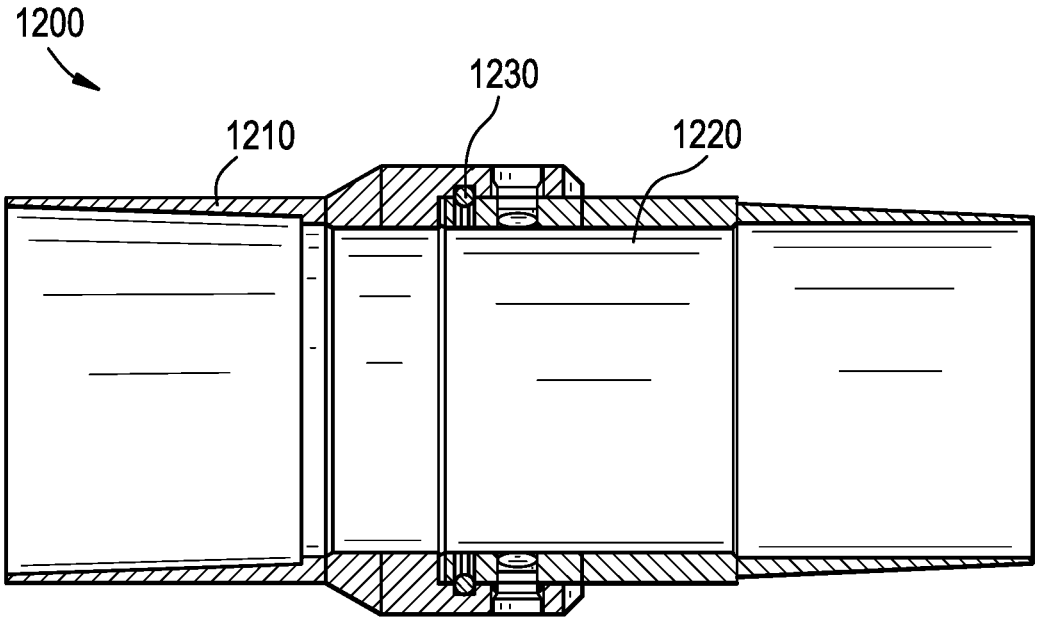
FIGS. 12-13 depict a lower body of toe sleeve that is configured to be disengaged with upper body, according to an embodiment.
Figure 13:
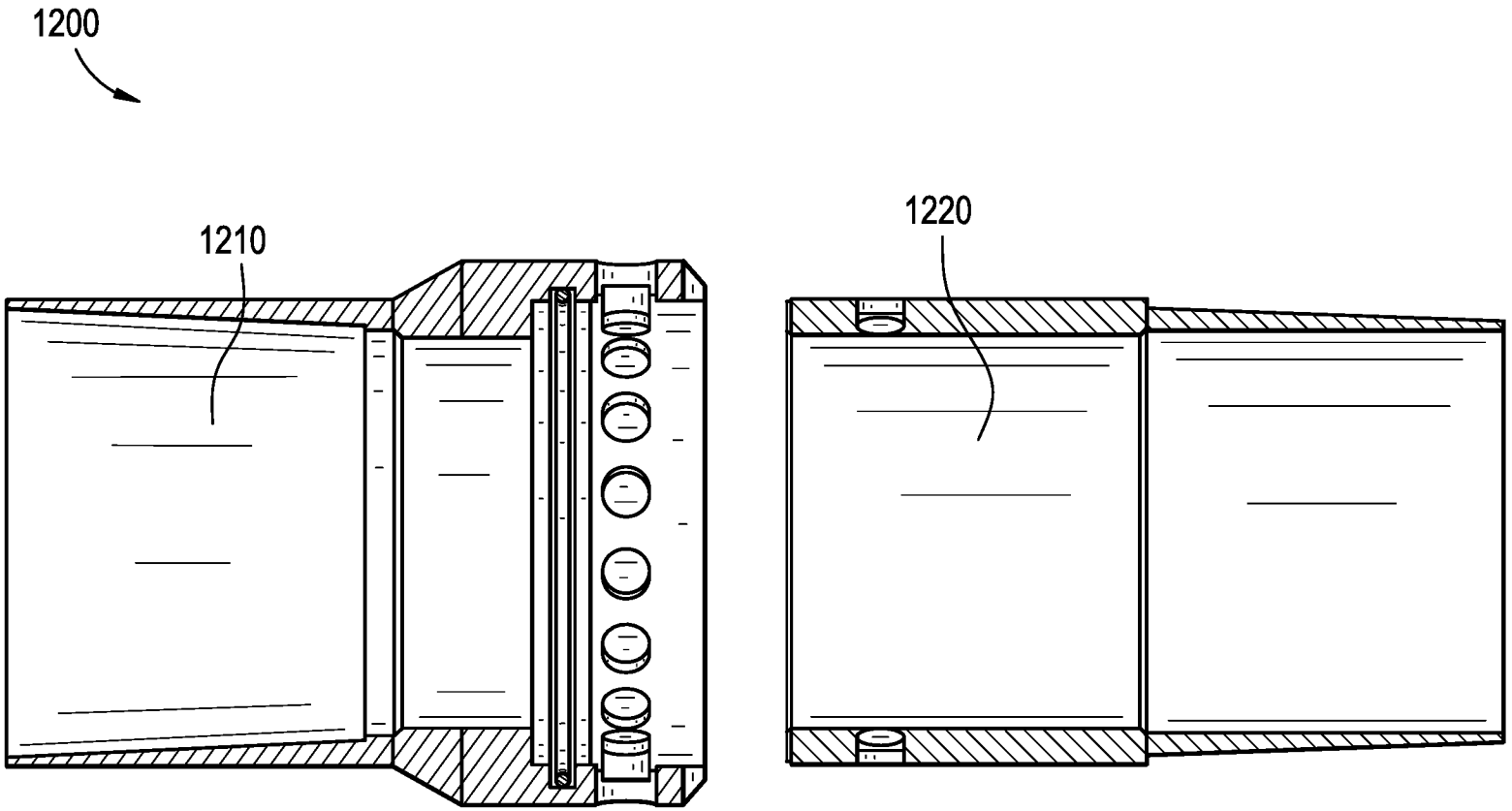

FIGS. 12-13 depict a lower body 1220 of toe sleeve 1200 that is configured to be disengaged with upper body 1210. As depicted in FIG. 12, lower body 1220 and upper body 1210 may be configured to be coupled together via a temporary coupling mechanism 1230. Responsive to increasing the pressure within toe sleeve 1200, the temporary coupling mechanism 1230 may sheer.

As depicted in FIG. 13, this may allow lower body 1220 to travel downhole and no longer be coupled with upper body 1210.

Figure 14:
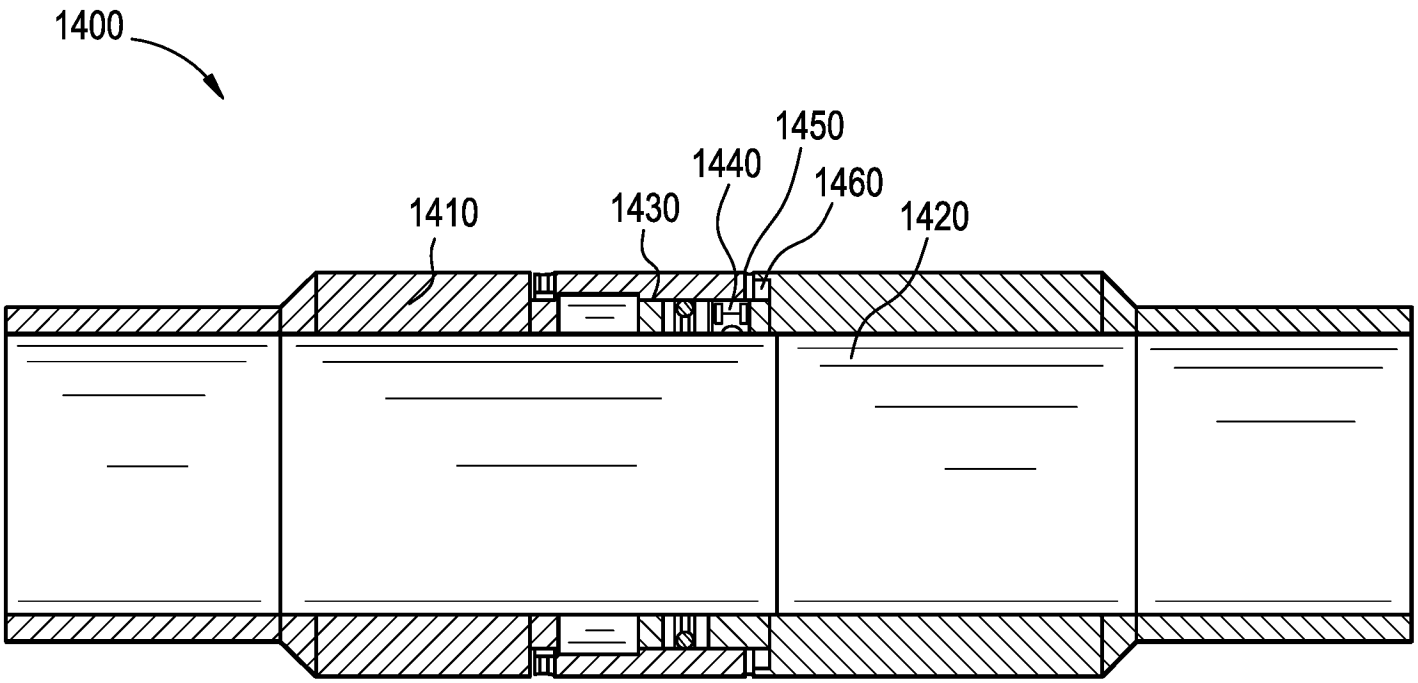
FIGS. 14-15 depict a toe sleeve that is formed of two pieces separable parts, according to an embodiment.
Figure 15:
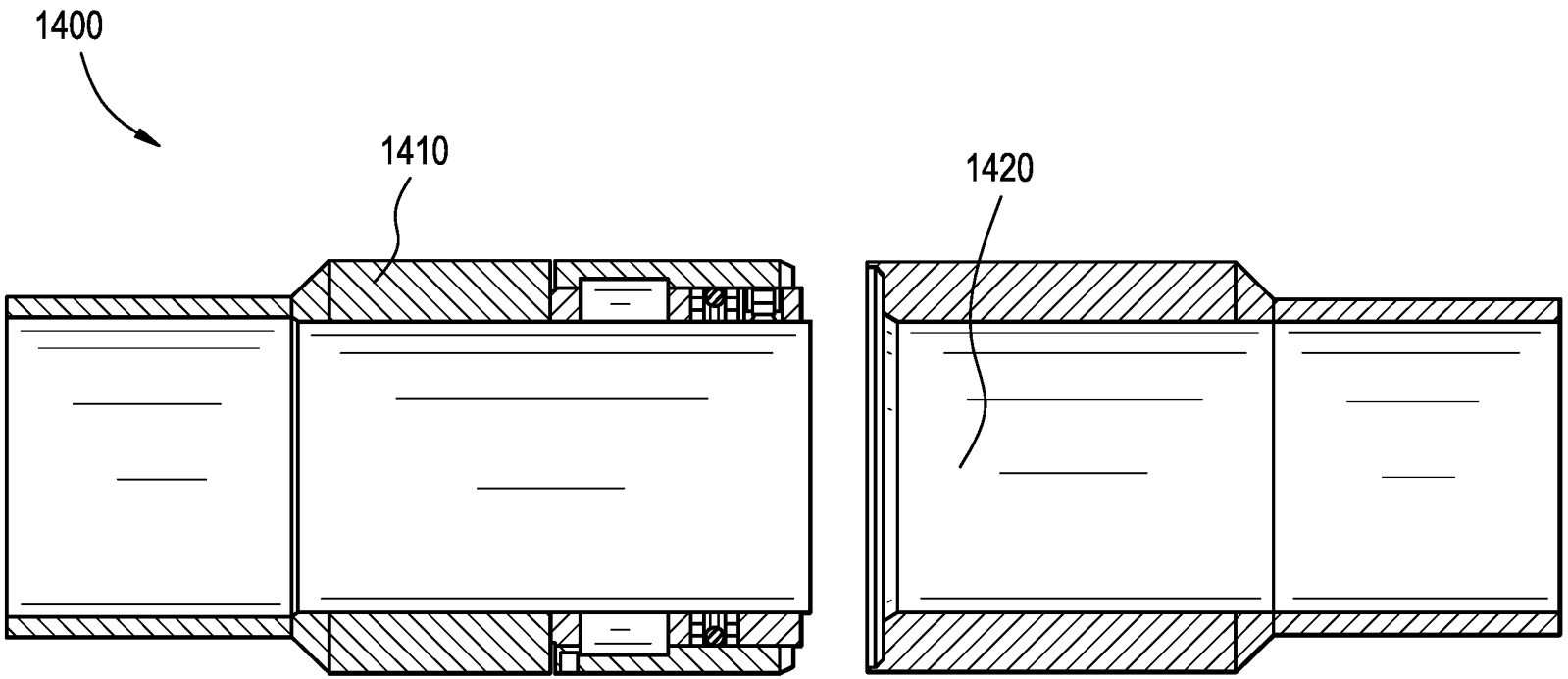

FIGS. 14-15 depict a toe sleeve 1400 that is formed of two pieces separable parts, lower body 1420 and upper body 1410.

As depicted in FIG. 14, lower body 1420 and upper body 1410 may be configured to be coupled together via threads or other permanent coupling 1430. Further, the upper body 1410 may be configured to accept a rupture disc 1440. When rupture disc 1440 is installed and intact, the upper body 1410 it may create a sealed chamber 1460 positioned between an external circumference of upper body 1420 and an internal circumference of lower body 1420. Sealed chamber 1460 may be atmospheric chamber with a static pressure.

The lower body 1420 may have a dent, weak point, etc. 1450 across its outer circumference that extends towards the central axis of lower body 1420, which may create a weak point. Responsive to increasing the pressure within toe sleeve 1400, the temporary rupture disc 1440 may shear and flood the atmospheric chamber 1460 to remove the static pressure within atmospheric chamber 1460. This may create a bigger piston area able to exert force on lower body 1420. Upon applying more pressure against lower body 1420, the lower body 1420 may sever/shear across the plane separating the lower body 1420 from upper body 1410 along dent 1450. In other embodiments, the rupture disc 1440 can be mounted on the lower body 1420, while the dent 1450 can be machined on the upper body 1410.

As depicted in FIG. 15, this may allow lower body 1420 to travel downhole and no longer be coupled with upper body 1410. This may give a direct and unrestricted access to formation by dynamically increasing separation gap between upper body 1410 and lower body 1420 with increased pressure.

Figure 16:
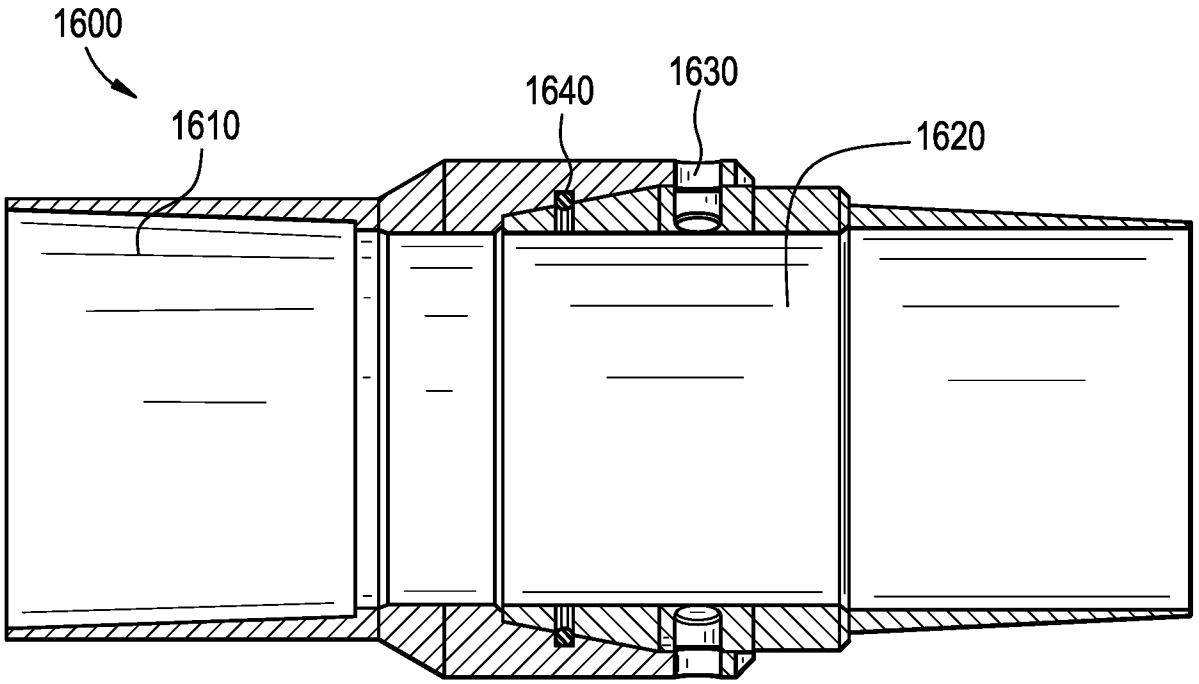
FIG. 16-17 depict a toe sleeve with a lower body that is configured to be disengaged from upper body, according to an embodiment.
Figure 17:
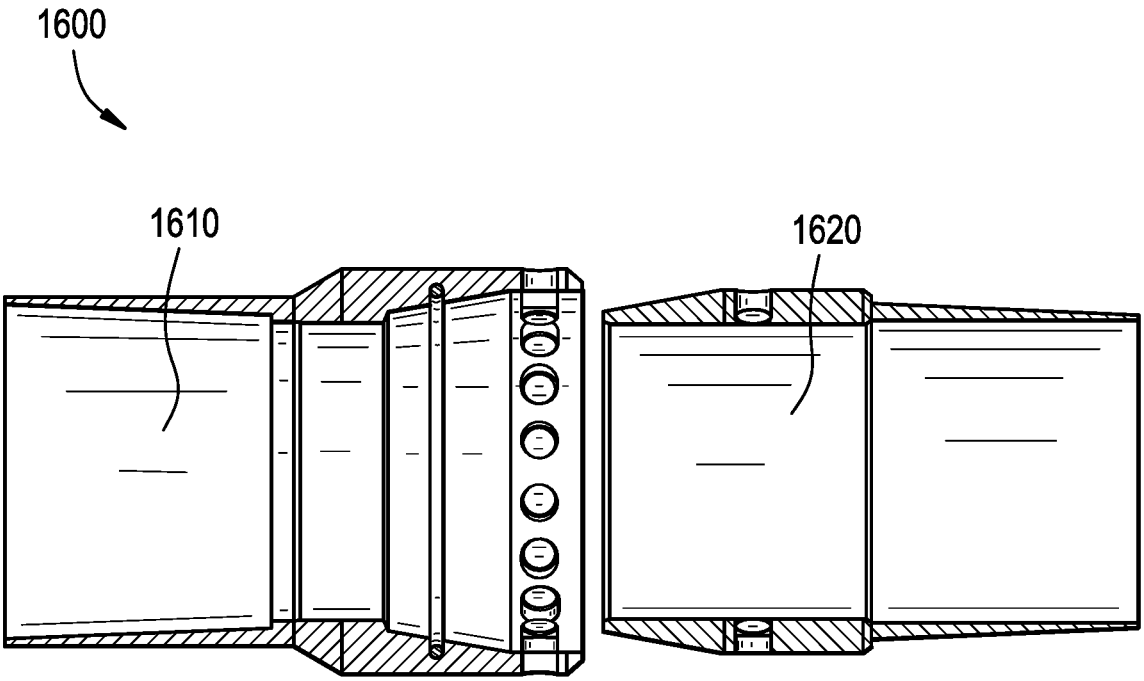

FIG. 16-17 depict a toe sleeve 1600 with lower body 1620 that is configured to be disengaged from upper body 1610. As depicted in FIG. 16, upper body 1620 and lower body 1610 may be configured to be coupled together via a temporary coupling mechanism 1630. Further, toe sleeve 1600 may have a seal 1640. Seal 1640 may be configured to not allow communication between an outer circumference of lower body 1620 and an inner diameter of upper body 1610. Responsive to increasing the pressure within tool 1600, the temporary coupling mechanism 1630 may sheer.

As depicted in FIG. 17, this may allow lower body 1620 to travel downhole and no longer be coupled with upper body 1610.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

A toe sleeve that is configured to disconnect from casing. More specifically, a toe sleeve that is configured to shear from casing creating a dynamic opening that does not get plugged.

What is claimed is:

1. A casing disconnecting tool comprising:

an upper body;

a lower body;

a temporary coupling mechanism configured to selectively couple the upper body and the lower body, wherein when the temporary coupling mechanism is coupling the upper body and the lower body the lower body is partially encompassed by the upper body;

a chamber positioned between the upper body and the lower body configured to aid in creating a force to eject portions of the lower body from the upper body responsive to shearing the temporary coupling mechanism, wherein the chamber is an atmospheric chamber before the shearing of the temporary coupling mechanism.

2. The tool of claim 1, wherein the entirety of the lower body is ejected from the upper body responsive to shearing the temporary coupling mechanism.

3. The tool of claim 1, wherein a proximal end of the lower body is encompassed by the upper body after the chamber creates the aided force to eject portions of the lower body from the upper body.

4. The tool of claim 1, wherein a lower body distal end projects away from an upper body distal end when the temporary coupling mechanism is coupling the upper body from the lower body.

5. The tool of claim 1, further comprising:

ports positioned through the lower body, the ports being configured to create dynamic openings allowing communication into the geological formation based on a change to a relative positioning of the lower body and the upper body caused by the aided force created by the chamber.

6. The tool of claim 5, wherein the ports are completely exposed to the geological formation after the portions of the lower body are ejected from the upper body.

7. The tool of claim 1, wherein cement is configured to be pumped through the lower body before the chamber creates the aided force.

8. The tool of claim 1, further comprising:

a rupture disc configured to seal the chamber, wherein the chamber is configured to increase a piston area acting upon the lower body responsive to the rupture disc being removed, wherein when the rupture disc is intact the rupture disc is positioned between a proximal end of the lower body and the temporary coupling mechanism.

9. A method for a casing disconnecting tool comprising:

temporarily coupling an upper body and a lower body at a first location, wherein when the upper body is coupled to the lower body then the lower body is partially encompassed by the upper body;

creating a force within a chamber to decouple the upper body and the lower body at the first location, the chamber being positioned between the upper body and the lower body, wherein the chamber is an atmospheric chamber before the shearing of the temporary coupling mechanism;

ejecting portions of the lower body from the upper body responsive to decoupling the upper body from the lower body at the first location.

10. The method of claim 9, further comprising:

ejecting the entirety of the lower body from the upper body responsive to decoupling the upper body and the lower body at the first location.

11. The method of claim 9, wherein a proximal end of the lower body is encompassed by the upper body after the chamber creates the force to eject portions of the lower body from the upper body.

12. The method of claim 9, wherein a lower body distal end projects away from an upper body distal end when the temporary coupling mechanism is coupling the upper body from the lower body.

13. The method of claim 9, further comprising:

creating dynamic openings, via ports positioned through the lower body, to allow communication into the geological formation based on a change to a relative positioning of the lower body and the upper body caused by the force created by the chamber.

14. The method of claim 13, wherein the ports are completely exposed to the geological formation after the portions of the lower body are ejected from the upper body.

15. The method of claim 9, further comprising:

pumping cement through the lower body before the chamber creates the force.

16. The method of claim 9, further comprising:

sealing the chamber via a rupture disc, wherein the chamber is configured to increase a piston area acting upon the lower body responsive to the rupture disc being removed, wherein when the rupture disc is intact the rupture disc is positioned between a proximal end of the lower body and the first location.

* * * * *